US008905126B2

(12) United States Patent
Krieg et al.

(10) Patent No.: US 8,905,126 B2
(45) Date of Patent: Dec. 9, 2014

(54) EXPANDABLE MILL AND METHODS OF USE

(75) Inventors: George N. Krieg, Broussard, LA (US); David Hebert, Scott, LA (US)

(73) Assignee: Baker Hughes Incorporated, Houston, TX (US)

( * ) Notice: Subject to any disclaimer, the term of this patent is extended or adjusted under 35 U.S.C. 154(b) by 642 days.

(21) Appl. No.: 13/108,750

(22) Filed: May 16, 2011

(65) Prior Publication Data

US 2011/0214873 A1 Sep. 8, 2011

Related U.S. Application Data

(63) Continuation-in-part of application No. 12/411,604, filed on Mar. 26, 2009, now Pat. No. 8,141,627.

(51) Int. Cl.

| | |
|---|---|
| ***E21B 37/04*** | (2006.01) |
| ***E21B 37/00*** | (2006.01) |
| ***E21B 37/02*** | (2006.01) |

(52) U.S. Cl.

CPC ..... *E21B 37/00* (2013.01); *E21B 37/02* (2013.01)

USPC ..... 166/174

(58) Field of Classification Search

USPC ..... 166/170, 172–175, 311, 318; 175/237, 175/268, 271, 270, 273, 284

See application file for complete search history.

(56) References Cited

U.S. PATENT DOCUMENTS

| | | | | |
|---|---|---|---|---|
| 2,845,129 | A | 7/1958 | Baker | |
| 2,857,141 | A | 10/1958 | Carpenter | |
| 3,433,313 | A * | 3/1969 | Brown | 175/270 |
| 4,291,764 | A | 9/1981 | Pampell | |
| 5,000,260 | A | 3/1991 | Fontenot | |
| 6,131,622 | A | 10/2000 | Ross | |
| 6,152,221 | A | 11/2000 | Carmichael et al. | |
| 6,253,861 | B1 | 7/2001 | Carmichael et al. | |
| 6,464,010 | B1 | 10/2002 | Brown | |
| 6,575,239 | B2 | 6/2003 | Allen | |
| 6,615,933 | B1 | 9/2003 | Eddison | |
| 7,121,343 | B2 | 10/2006 | Telfer | |
| 7,191,835 | B2 | 3/2007 | Howlett et al. | |
| 7,493,971 | B2 * | 2/2009 | Nevlud et al. | 175/266 |
| 2002/0005284 | A1 | 1/2002 | Allen | |
| 2007/0089912 | A1 * | 4/2007 | Eddison et al. | 175/269 |
| 2007/0187115 | A1 * | 8/2007 | Read | 166/386 |
| 2009/0025927 | A1 | 1/2009 | Telfer | |
| 2009/0056952 | A1 * | 3/2009 | Churchill | 166/373 |
| 2011/0114334 | A1 * | 5/2011 | Palacios | 166/373 |
| 2011/0155465 | A1 * | 6/2011 | Allamon et al. | 175/57 |

OTHER PUBLICATIONS

MI Swaco, "Ridge Back Burr Mill", MI SWACO Product Information Brochure, 2007, p. 1-2.

Baker Oil Tools, "Expanding Hydraulic Mill Product No. 150-98", Baker Oil Tools product information brochure.

* cited by examiner

*Primary Examiner* — Shane Bomar
*Assistant Examiner* — Kipp Wallace
(74) *Attorney, Agent, or Firm* — E. Randall Smith; Jones & Smith, LLP

(57) ABSTRACT

In some embodiments, apparatus useful for cleaning at least part of the interior surface of a generally cylindrically-shaped member disposed in a subterranean well includes a housing and a plurality of retractable mill blades supported on the housing and movable from an initial retracted position to an extended position and thereafter to a final retracted position.

20 Claims, 12 Drawing Sheets

EXPANDABLE MILL AND METHODS OF USE

This application is a continuation-in-part of and claims priority to U.S. patent application Ser. No. 12/411,604 filed Mar. 26, 2009, entitled "Expandable Mill and Methods of Use", which is hereby incorporated by reference herein in its entirety.

FIELD OF THE INVENTION

The present disclosure relates generally to well cleaning apparatus and methods and, more particularly, to cleaning a surface or area of one or more among an underground well, casing, liner, pipe and the like.

BACKGROUND OF THE INVENTION

In hydrocarbon recovery operations in subterranean wells, it is often necessary or desirable to clean debris from one or more surface or area of the well or component(s) in the well. For example, after a casing is perforated, it is typically desirable to remove perforating burrs and other debris from inside the casing or liner prior to the installation of completion equipment.

However, various presently known tools and techniques for cleaning underground surfaces or areas are believed to have one or more drawbacks. For one potential example, when an obstruction is detected in the well during drifting of the casing, the drift sub or other tool often needs to be entirely removed from the well to allow insertion of a suitable cleaning tool, such as a convention mill. This process requires an additional round trip into the well. For another example, some existing tools are believed to be limited to performing cleaning during rotation, which may be undesirable or impossible when there are torque related problems or other limiting conditions. In some instances, existing cleaning technology may not be capable of providing full coverage in deviated or horizontal wells. Some existing tools may also, or instead, be ineffective at accommodating turbulent fluid flow or directing debris upwardly for disposal. Various known cleaning tools having milling ribs are believed to be unable to provide full coverage of the inner diameter of the item to be cleaned, ineffective at transmitting rotational torque to the tool body, or not fully retractable (beyond the outer diameter of the tool or other components) when deactivated. For yet other examples, known tools may include externally exposed connectors or components that can become dislodged and cause problems in the casing or well bore, not allow unrestricted fluid flow through the tool after deactivation or include deactivation mechanisms that could bind up or malfunction.

It should be understood that the above-described discussion is provided for illustrative purposes only and is not intended to limit the scope or subject matter of the appended claims or those of any related patent application or patent. Thus, none of the appended claims or claims of any related patent application or patent should be limited by the above discussion or required to address, include or exclude each or any particular of the above-cited examples, features and/or disadvantages merely because of their mention above.

Accordingly, there exists a need for improved systems, apparatus and methods capable of cleaning an underground surface or area in a subterranean well and having one or more of the attributes, capabilities or features described below or evident from the appended drawings.

BRIEF SUMMARY OF THE DISCLOSURE

In some embodiments, the present disclosure involves a drift sub equipped to be capable of cleaning at least part of the interior surface of a casing in a subterranean well prior to the insertion therein of completion hardware and/or accessories. The drift sub includes a tubular housing having an upper end, a lower end and a bore extending therebetween, the housing being deployable into and moveable within the casing. A plurality of mill blades are supported on the housing and arranged in at least one row around the outer circumference of the housing. Each mill blade is movable between at least one retracted position and at least one extended position relative to the housing. The mill blades in the extended position extend radially outwardly beyond the outer diameter of the housing and are capable of contacting the interior surface of the casing. The mill blades in the retracted position are unable to contact the interior surface of the casing. The mill blades are initially positioned in a retracted position upon deployment of the housing into the casing.

In these embodiments, an inner sleeve is disposed within the bore of the housing and biasingly engages each mill blade. The inner sleeve is configured to be selectively movable axially relative to the housing only in the direction of the lower end thereof from at least a first position to a second position, and therefrom to a third position. The inner sleeve in the first and third positions biases the mill blades in a retracted position, and the inner sleeve in the second position biases the mill blades in an extended position. An outer sleeve is disposed within the bore radially outwardly relative to the inner sleeve and is releasably engaged therewith. The outer sleeve is configured to be selectively moveable axially relative to the housing only in the direction of the lower end thereof from at least a first position to a second position. Movement of the outer sleeve from its first position to its second position causes the inner sleeve to move from its first position to its second position.

The inner and outer sleeves of these embodiments are configured to be positioned in their respective first positions upon deployment of the housing into the casing. Thereafter, movement of the outer sleeve from its first position to its second position moves the inner sleeve from its first position to its the second position, causing the mill blades to move into the extended position. Movement thereafter of the inner sleeve from its second position to its third position causes the mill blades to move into the retracted position. The inner sleeve in its third position is unable to move back to its first or second positions, securing the mill blades in the retracted position.

In various embodiments, the present disclosure involves apparatus useful to clean at least part of the interior surface of a generally cylindrically-shaped member in a subterranean well. The apparatus includes a housing having an upper end, a lower end and a bore extending therebetween. The housing is deployable into and moveable within the generally cylindrically-shaped member. A plurality of mill blades are supported on the housing and arranged in at least one row around the outer circumference of the housing. Each mill blade is movable between at least one retracted position and at least one extended position relative to the housing. The mill blades in an extended position extend radially outwardly beyond the outer diameter of the housing and are capable of contacting the interior surface of the generally cylindrically-shaped member. The mill blades in a retracted position are unable to contact the interior surface of the generally cylindrically-shaped member. The mill blades are initially positioned in the retracted position upon deployment of the housing into the generally cylindrically-shaped member.

In these embodiments, an inner sleeve is disposed within the bore of the housing and biasingly engages each mill blade. The inner sleeve is configured to be selectively movable axially relative to the housing only in the direction of the lower end thereof from at least a first position to a second position, and therefrom to a third position. The inner sleeve in the first and third positions biases the mill blades in a retracted position, and the inner sleeve in the second position biases the mill blades in an extended position. An outer sleeve is disposed within the bore radially outwardly relative to the inner sleeve and is releasably engaged therewith. The outer sleeve is configured to be selectively moveable axially relative to the housing only in the direction of the lower end thereof at least from a first position to a second position. Movement of the outer sleeve from its first position to its second position causes the inner sleeve to move from its first position to its second position.

In these embodiments, first and second detachable seats are releasably engaged with the outer and inner sleeves, respectively. The first detachable seat is useful to catch a first activating member inserted into the bore of the housing and move the inner and outer sleeves from their respective first to second positions. The second detachable seat is useful to catch a second activating member inserted into the bore and move the inner sleeve from its second to third positions.

In many embodiments, the present disclosure involves a method of cleaning debris from at least part of the interior surface of a generally cylindrically-shaped member in a subterranean well with the use of a housing having a plurality of spring-biased mill blades associated therewith. The mill blades are arranged in at least one row around the outer circumference of the housing. Each mill blade is movable from a retracted position to an extended position and therefrom to a retracted position relative to the housing. The mill blades in an extended position extend radially outwardly beyond the outer diameter of the housing and are capable of contacting the interior surface of the generally cylindrically-shaped member. The mill blades in a retracted position are not capable of contacting the interior surface of the generally cylindrically-shaped member. The method includes positioning the mill blades in a retracted position and inserting the housing into the generally cylindrically-shaped member. The mill blades are moved into an extended position and the housing is reciprocated to allow the mill blades to clean the interior surface of at least a portion of the cylindrically-shaped member. The mill blades are moved into a retracted position and thereafter not movable again into an extended position. The housing is removed from the generally cylindrically-shaped member.

Accordingly, the present disclosure includes features and advantages which are believed to enable it to advance well cleaning technology. Characteristics and potential advantages of the present disclosure described above and additional potential features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
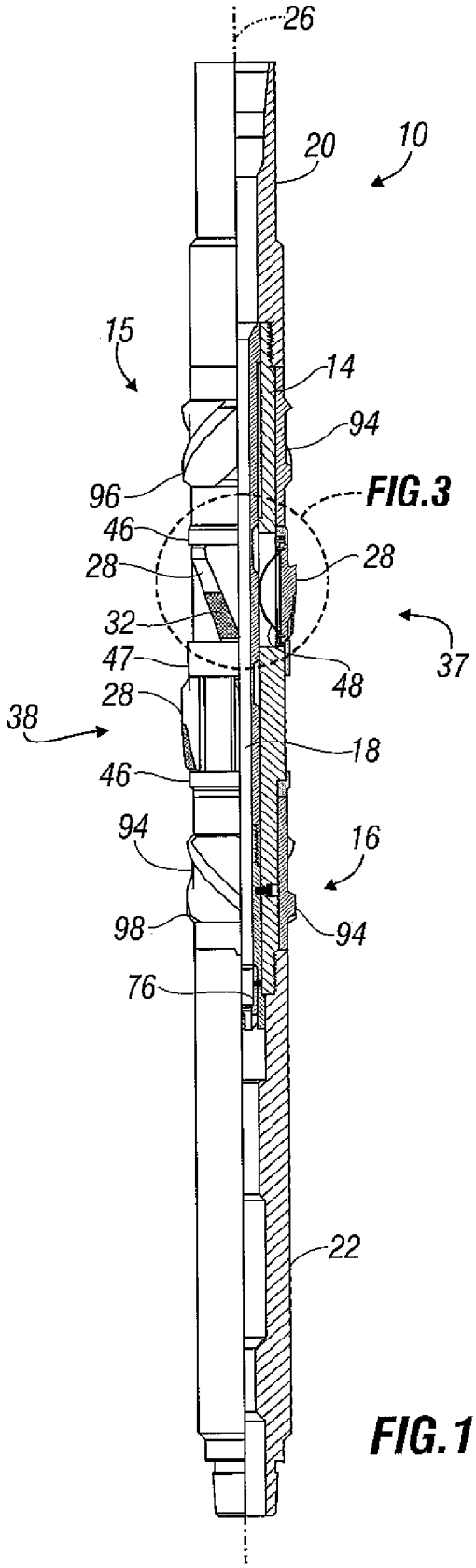
FIG. 1 is a partial cross-sectional view of an example cleaning system in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced in the appended figures with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 2:
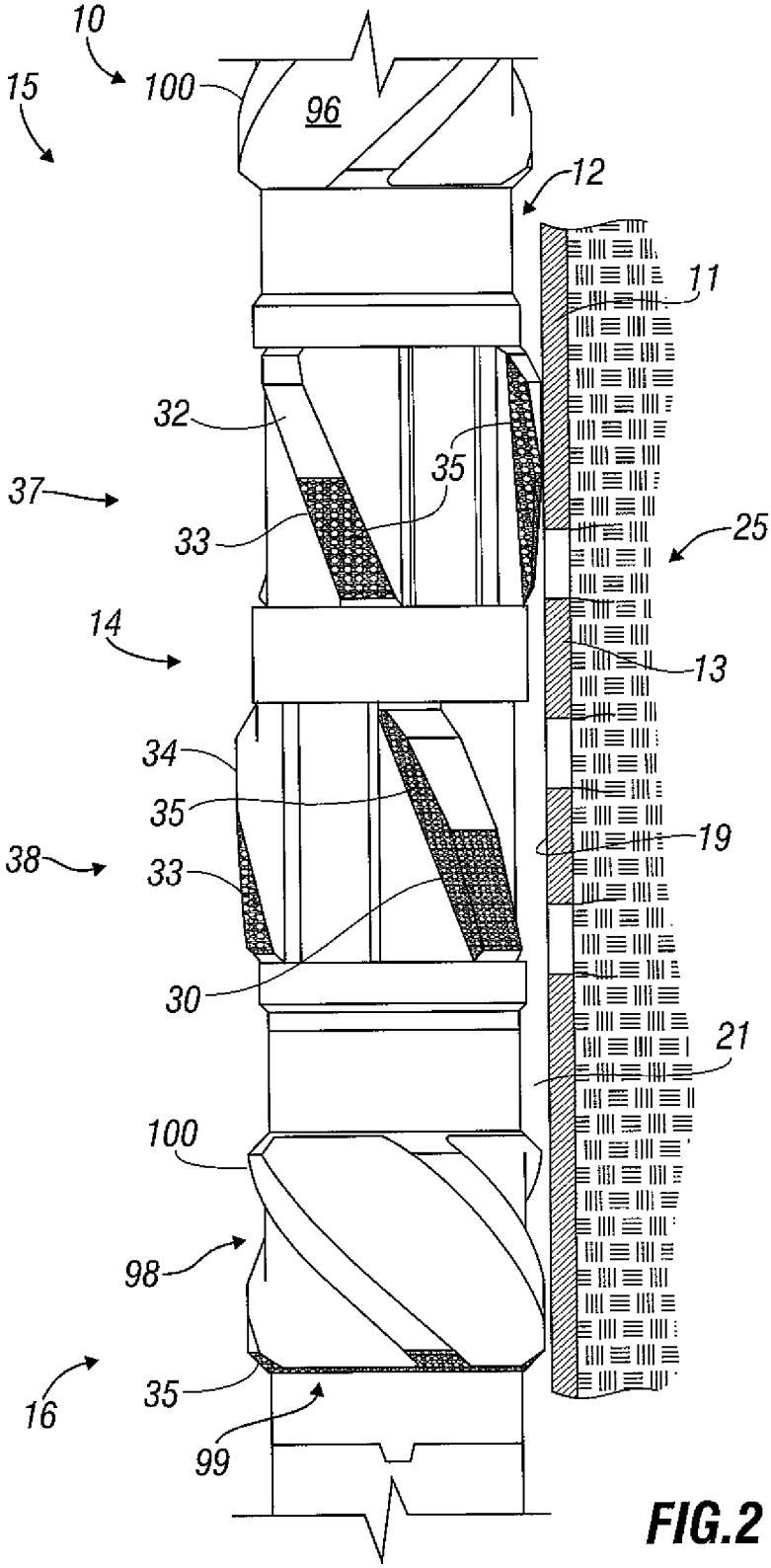
FIG. 2 is a front view of a portion of an embodiment of a cleaning system of the present disclosure disposed within an underground well.

Referring initially to FIGS. 1 and 2, an embodiment of a cleaning system 10 useful for cleaning at least one portion of a generally cylindrically-shaped member 11 (FIG. 2) in a subterranean well 12 is shown. The type of member 11 that often may be cleaned with the system 10 is typically a well casing 13, but may instead or also be a well liner, pipe and possibly even the wall of the well 12 itself. The portion of the member 11 that may be cleaned with the system 10 is typically the surface surrounding or adjacent to a bore 21 formed in the member 11, but may instead or also be other portions or surfaces of the member 11, such as a top edge or other portion thereof. Further, the member 11 or surface thereof, though typically having a generally cylindrical overall shape, may or may not be cylindrically-shaped. Thus, as used herein and in the appended claims, the term "generally cylindrically-shaped member" and variations thereof may include any one or more items or areas located underground and which includes a surface or portion that can be cleaned. Accordingly, the present invention and appended claims are not limited by the type of item or area with which it may be used, or the shape, orientation, construction, configuration or other details thereof.

For one example application, the system 10 may be used as a mechanical wellbore clean-up tool designed to remove perforation burrs and other debris from inside a casing 13 during post-perforation operations. This may be useful to prepare the inner diameter of the perforated interval of the casing 13 prior to installation of completion hardware, particularly if screens or packers are to be run during smart completion operations. However, the present invention includes embodiments which may not be useful in such application. Accordingly, the present disclosure and appended claims are not limited to this particular example.

Still referring to the embodiment of FIGS. 1 and 2, the illustrated system 10 includes a housing 14 and a plurality of mill blades 28. The exemplary housing 14 is tubular, or at least partially tubular in shape, and has at least one bore 18 extending therethrough along the longitudinal axis 26 thereof. The housing 14 is deployable and moveable within the generally cylindrically-shaped member 11. In this example, the housing 14 is threadably connectable at its upper end 15 with an upper sub, or tubing, 20 and at its lower end 16, with a lower sub, or tubing, 22. The upper and lower subs 20, 22 may have any desired form, configuration and features as are and become further known. Moreover, in some embodiments, other components may be included instead of the upper and/or lower subs 20, 22, which are therefore not required by or limiting upon the present invention.

Figure 10:
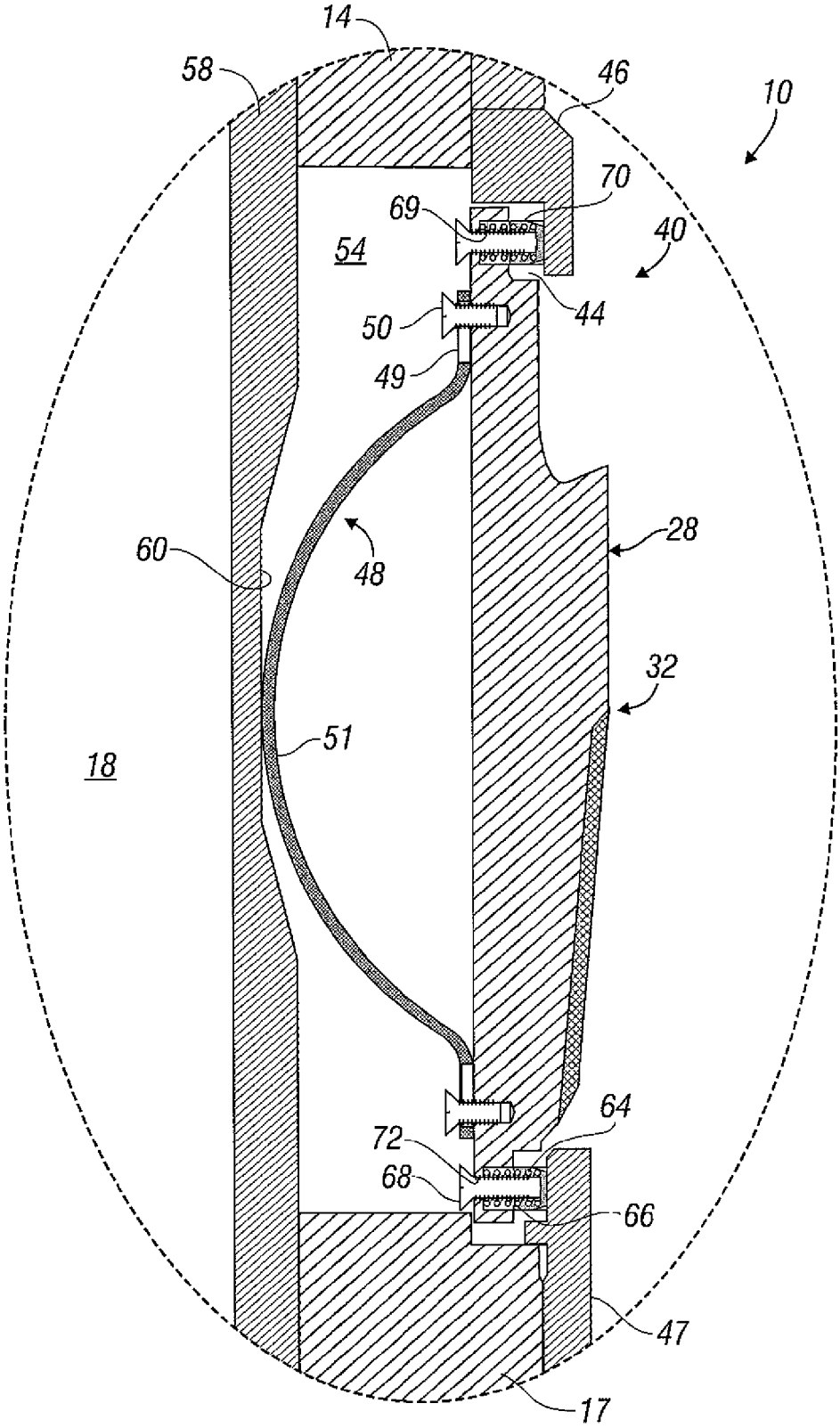
FIG. 10 is an exploded view of part of the example cleaning system of FIG. 9.

The mill blades 28 of this embodiment are supported on the housing 14, spring-biased radially outwardly from the housing 14 into an extended position (e.g. FIG. 3) and remotely moveable therefrom into a retracted position (e.g. FIG. 10). Each exemplary mill blade 28 includes at least one cleaning face 32 capable generally of contacting or cleaning the interior surface 19 of the generally cylindrically-shaped member 11 when the mill blades 28 are in an extended position. The illustrated mill blades 28 are configured so that their cleaning faces 32, in combination, will generally be able to span the entire inner diameter (not shown) of a portion of the bore 21 of the generally cylindrically-shaped member 11 when the housing 14 is deployed therein.

When the mill blades 28 of this embodiment are in an extended position, they are capable of at least substantially contacting and cleaning protruding debris from the entire circumference of the interior surface 19 of at least a portion of the member 11 upon reciprocation of the housing 14 therein. In some embodiments, when the exemplary mill blades 28 are in a retracted position (e.g. FIG. 10), their cleaning faces 32 will be spaced radially inwardly relative to the housing 14 and generally unable to contact the surface 19 of the member 11.

Still referring to the embodiment of FIGS. 1 and 2, the housing 14 and mill blades 28 may have any suitable construction, configuration and operation. In this particular example, the housing 14 is a single unitary component having a reduced thickness wall 17 proximate to its upper and lower ends 15, 16 to allow retainers 46, 47 (described below) and centralizers 94 (also described below) to be retained thereon. Each mill blade 28 is generally spirally-oriented on the housing 14 in a counterclockwise direction (from top to bottom) and generally (right hand) helically-shaped. This configuration may be included for any desired purpose. For example, such configuration may allow 360 degree cleaning during reciprocation, such as described above. For another possible example, if the housing 14 may be rotated to clean the member 11, this configuration may avoid inadvertent uncoupling of the housing 14 from a threadably connected lower sub 22 during rotation.

Figure 3:
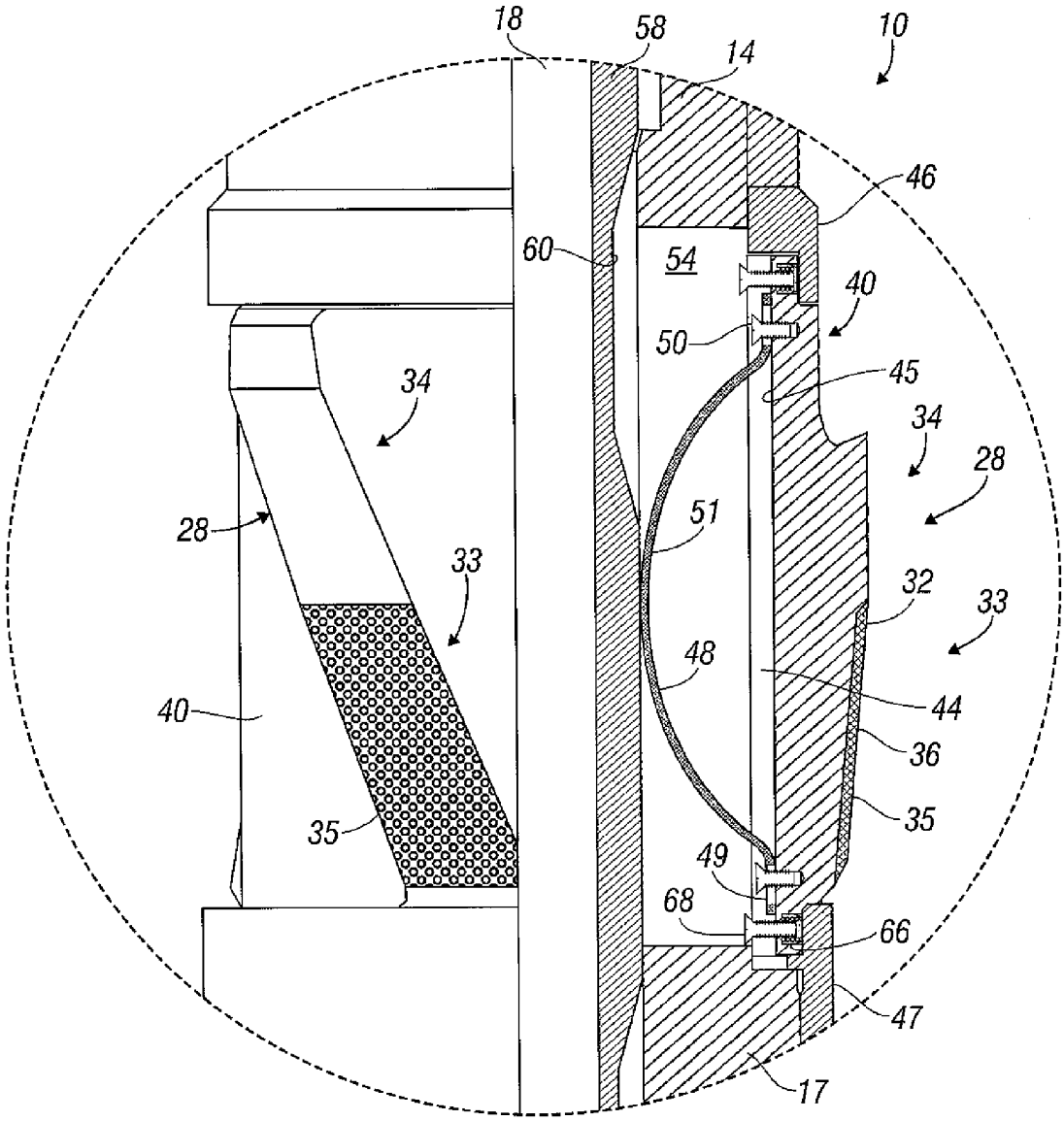
FIG. 3 is an exploded view of part of the example cleaning system of FIG. 1.

Now referring to FIG. 3, the cleaning face 32 of each mill blade 28 of this embodiment includes a lower portion 33, which tapers down from an upper portion 34 and includes one or more coating or layer of high strength material (HSM) 35. Examples of HSM 35 may include tungsten carbide, a composite including tungsten carbide or other material(s). This tapered configuration may be useful in some applications, for example, to allow effective cleaning of the desired perforated interval 25 (e.g. FIG. 2) as the housing 14 approaches it. If desired, the lower portion 33 of the face 32 may have a recess, or cut-out 36 which can be filled or coated with the HSM 35.

In some designs, for example, the cut-out 36 may be approximately ⅛" deep to allow an approximate ⅛" thick layer of HSM 35.

If desired, one or more other portion of the mill blades 28 may also include HSM 35, such as to assist in the cleaning process. For example, one or more side of each mill blade 28 may include HSM 35. In the embodiment of FIG. 2, the right, or leading, side 30 of each mill blade 28 is shown including at least one layer or coating of HSM 35. This may be useful, for example, to assist in cleaning burrs from the member 11 during clockwise rotation of the housing 14. However, the present invention neither requires the use of HSM 35 nor is not limited to the details described above.

Referring back to FIGS. 1 and 2, in an independent aspect of the present disclosure, the mill blades 28 of this example are shown arranged in first and second rows 37, 38 on the housing 14. In this embodiment, there are three mill blades 28 on each row spaced apart by approximately 120 degrees. The mill blades 28 of each row 37, 38 are offset by approximately 60 degrees relative to the mill blades 28 of the other row. However, any other suitable quantity and configuration of mill blades 28 and rows.

Figure 4:
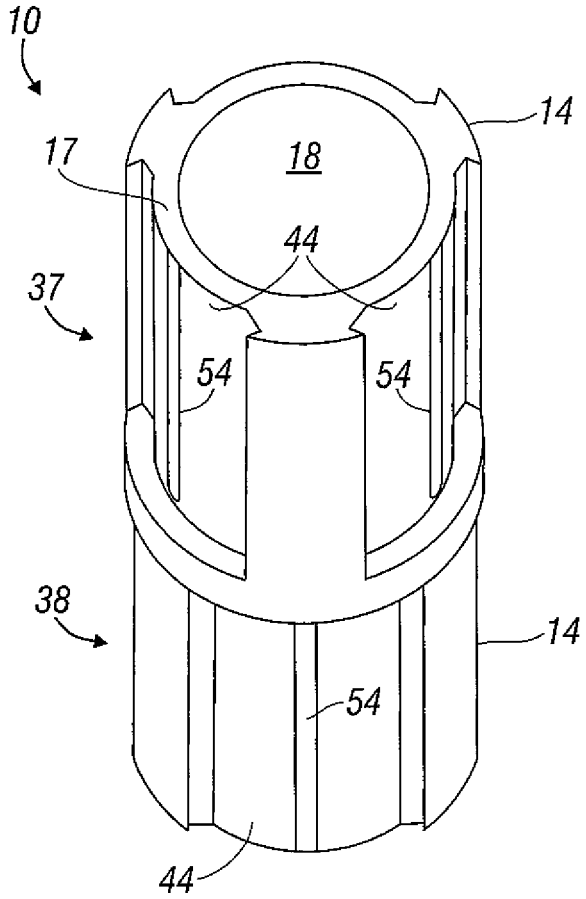
FIG. 4 is a perspective view of a portion of a housing of an embodiment of a cleaning system of the present disclosure.

In another independent aspect of the present disclosure, as shown in FIG. 3, each mill blade 28 of this example is disposed upon and extends radially outwardly from an insert 40 that is located in a pocket 44 formed in the housing 14. In other embodiments, multiple mill blades 28 may be provided on the same insert 40. The exemplary pockets 44, as illustrated in FIG. 4, extend only partially into the wall 17 of the housing 14 and are arranged in spaced relationship with one another around the circumference of the housing 14 in the first and second rows 37, 38. As shown, the pockets 44 in the first row 37 are offset relative to the pockets 44 of the second row 38.

Referring back to the embodiment of FIG. 3, each insert 40 is shown retained in its respective pocket 44, such as with the use of retainers 46, 47. The retainers 46, 47 may, for example, be end rings that are slideable over the housing 14, or any other suitable component(s). Each exemplary insert 40 is moveable within its respective pocket 44 between at least one extended and at least one retracted position. The travel of each insert 40 (and its corresponding mill blade(s) 28) between a fully extended and a fully retracted position is defined by the depth of the associated pocket 44. The insert 40 thus cannot retract into the bore 18 of the housing 14. Further, at least some torque that may be applied to any mill blade 28 during operation is transmittable to the wall 17 of the housing 14 at the associated pocket 44.

Still referring to FIG. 3, the mill blades 28 may be biased radially outwardly into an extended position, such as to ensure full contact with the inner diameter of the member 11, and movable therefrom to a retracted position relative to the housing 14 in any suitable manner and with any suitable components. In this embodiment, a bow spring 48 is engaged at its ends with the rear side 45 of each insert 44 by screws 50. Each exemplary screw 50 engages over a slot 49 in the bow spring 48, so that as the bow spring 48 expands, the ends of the bow spring 48 may move or slide relative to the screws 50, such as described below.

The bow springs 48 of this embodiment are aligned generally with the longitudinal axis 26 (FIG. 1) of the housing 14. The mid-portion, or bow, 51 of each illustrated bow spring 48 extends into the associated pocket 44 and through a slot 54 extending entirely through the wall 17 of the housing 14 to the bore 18 of the housing 14. This configuration may, for example, assist in preventing the springs 48 from becoming hung up in, or otherwise hinder operation of the, mill blade retraction mechanism, an example of which is described below.

Figure 5:
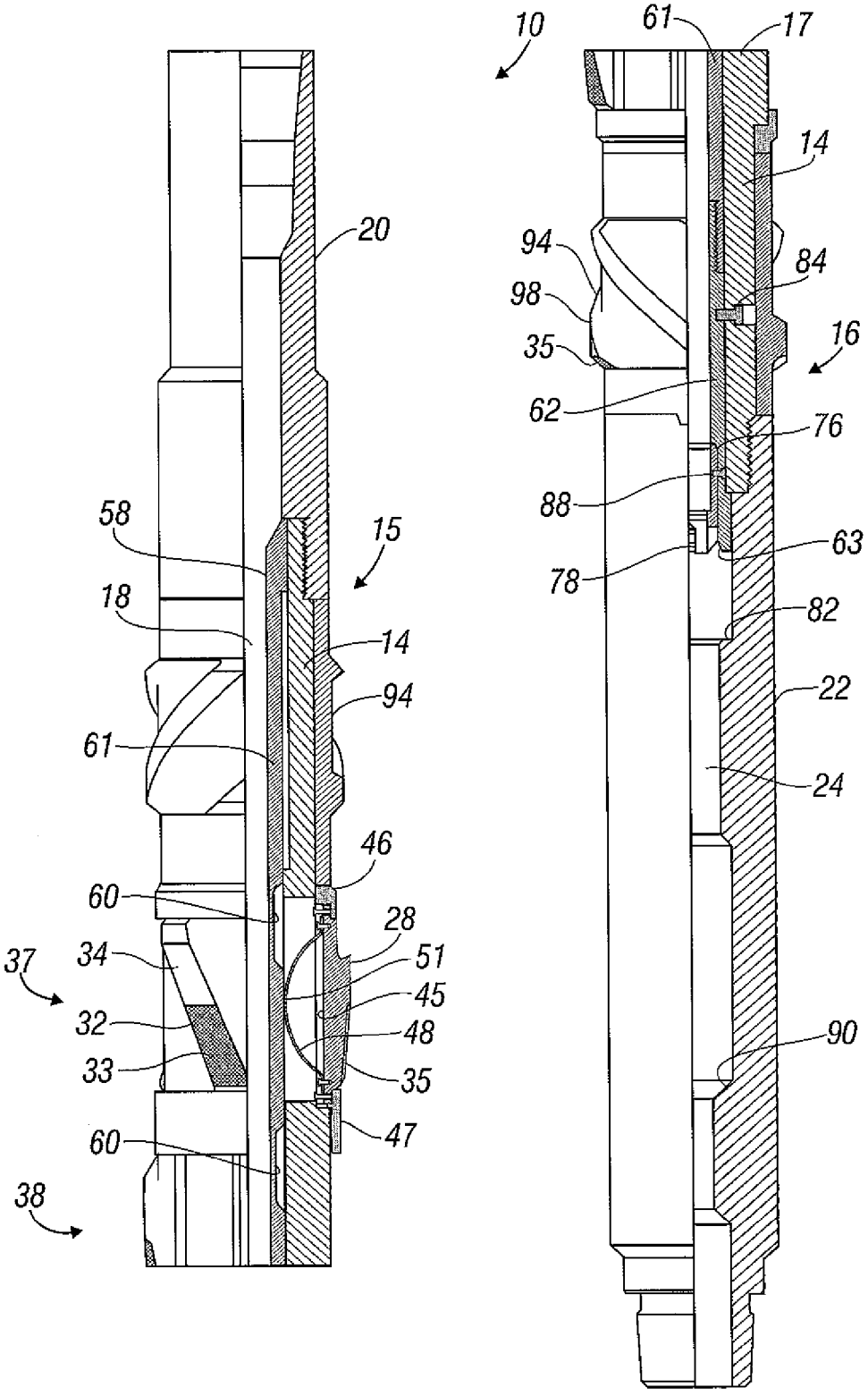
FIG. 5 is an enlarged partial cross-sectional view of the example cleaning system of FIG. 1 shown in two sections.

Referring to FIG. 5, in another independent aspect of the present disclosure, any suitable mechanism and technique for retracting the mill blades may be used. The mill blade retraction mechanism of this embodiment includes a slideable flow tube, or tubular sleeve, 58 disposed in the bore 18. The sleeve 58 contacts the bow 51 of each bow spring 48 and biases the bow springs 48 radially outwardly against the inserts 40. The exemplary flow tube 58 is selectively moveable axially within the bore 18 of the housing 14 between at least first and second positions. In FIG. 5, the tube 58 is shown in its first position, which corresponds with the extended position of the inserts 40 (and mill blades 28) and represents the assembled configuration of the system 10. As shown in FIG. 3, in the first position of the exemplary tube 58, each bow spring 48 is biased between the outer diameter of the tube 58 and the rear side 45 of its corresponding insert 40 sufficient to bias the insert 40 and associated mill blade(s) 28 into an extended position.

The exemplary second position of the tube 58 is shown in FIG. 10 and corresponds with the retracted position of the inserts 40. After the illustrated tube 58 is moved into the second position, the bow 51 of each bow spring 48 nests in an undercut 60 formed in the outer diameter of the tube 58. The undercut 60 of this embodiment is a thin-wall section of the tube 58, such as a groove or cut-out portion, which allows for radial inward expansion of the bow spring 48 and reduction in the spring force applied to the associated insert 40. Such reduction in spring force allows the associated insert 40 (and mill blade(s) 28) to move radially inwardly in its corresponding pocket 44 into a retracted position.

Figure 6:
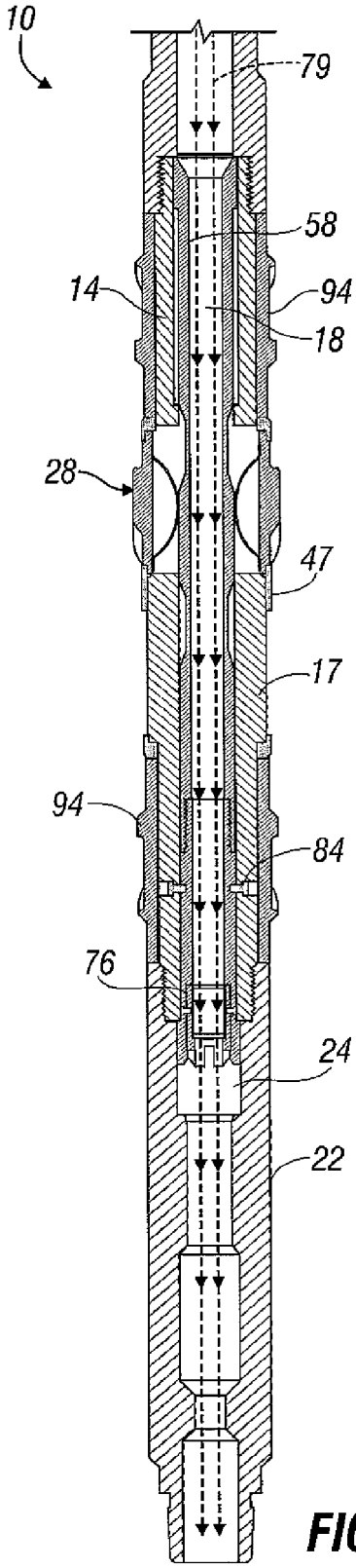
FIG. 6 is a cross-sectional view of an embodiment of a cleaning system in accordance with the present disclosure showing an open flow path therethrough.

Referring again to FIG. 5, the tube 58 may have any suitable construction, configuration and operation. In this embodiment, the tube 58 includes upper and lower tube sections 61, 62, which are threadably connected together. The tube 58 allows fluid flow through the bore 18 of the housing 14, as shown with arrows 79 in FIG. 6.

Figure 8:
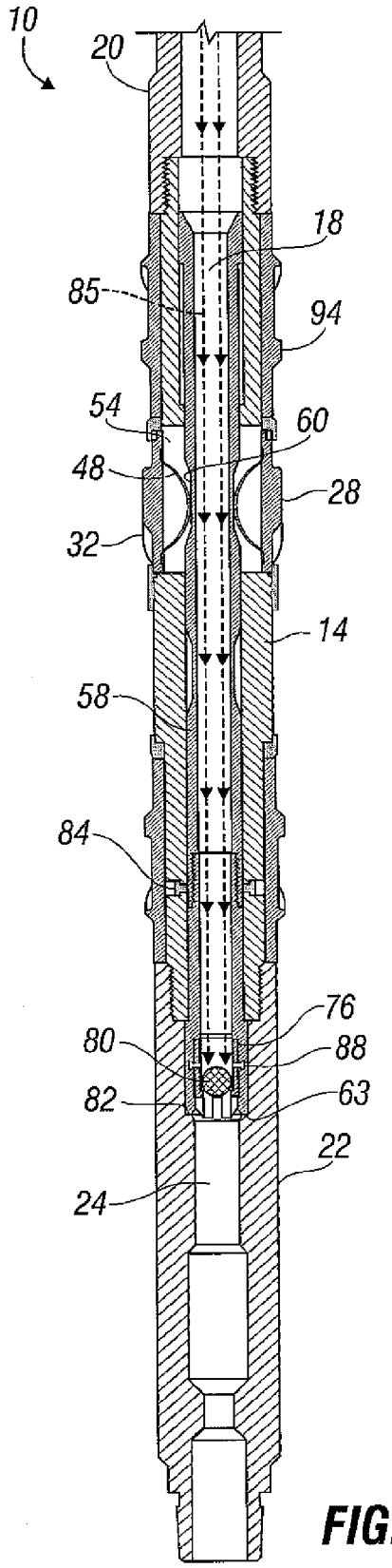
FIG. 8 is a cross-sectional view of the exemplary cleaning system of FIG. 6 showing the shifting of an exemplary mill blade deactivation tube in accordance with an embodiment of the present invention.

The tube 58 may be moveable between positions in any suitable manner. In this embodiment, the tube 58 is releasably connected with the housing 14 to allow its movement between first and second positions. At least one uncoupling member 84, such as a shear pin, shear screw or any other suitable component(s), is shown releasably connecting the tube 58 and housing 14. The illustrated uncoupling member 84 is configured to retain the tube 58 in its first position until cleaning is complete and, upon sufficient pressurization of the bore 18, to release and allow the tube 58 to move downwardly to its second position. Thereafter, in this example, the lower end 63 of the tube 58 will shoulder up and stop at a decreased ID portion, or shoulder 82, formed in the lower sub 22. This disposition of the illustrated tube 58, as shown in FIG. 8, defines its second position, in which the undercuts 60 formed in the tube 58 align with the slots 54 in the housing 14 and allow the bow springs 48 to expand therein (see also FIG. 10). However, the tube 58 or other mill blade retraction mechanism may be moveable between more than two positions.

Figure 7:
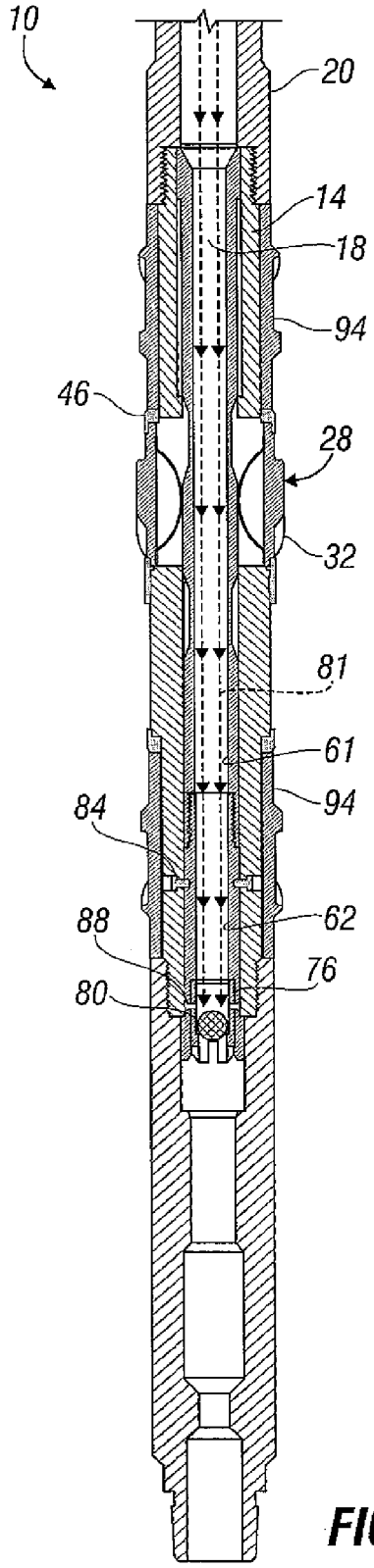
FIG. 7 is a cross-sectional view of the exemplary cleaning system of FIG. 6 showing the path of a ball of an example mill blade deactivation system seated in an exemplary ball seat.

In another independent aspect of the present disclosure, if desired, one or more mechanism or technique may be used to assist in selectively moving the tube 58 from its first to its second positions. Referring still to FIG. 5, this embodiment includes a ball seat 76 engaged with the tube 58. The exemplary ball seat 76 is capable of catching a ball 80 inserted into the bore 18 of the housing 14 and which will move or gravitate along the flow path 81 shown in FIG. 7. After the ball 80 is landed in the exemplary seat 76, sufficient pressurization in the bore 18 (such as shown in FIG. 8 with fluid flow arrows 85) will cause the uncoupling member(s) 84 to release and the tube 58 to move down to its second position. When the uncoupling member 84 is a shear pin, shear screw or the like, the amount of necessary bore pressurization may be selected based upon the shear valve of the uncoupling member 84, or vise versa.

Figure 9:
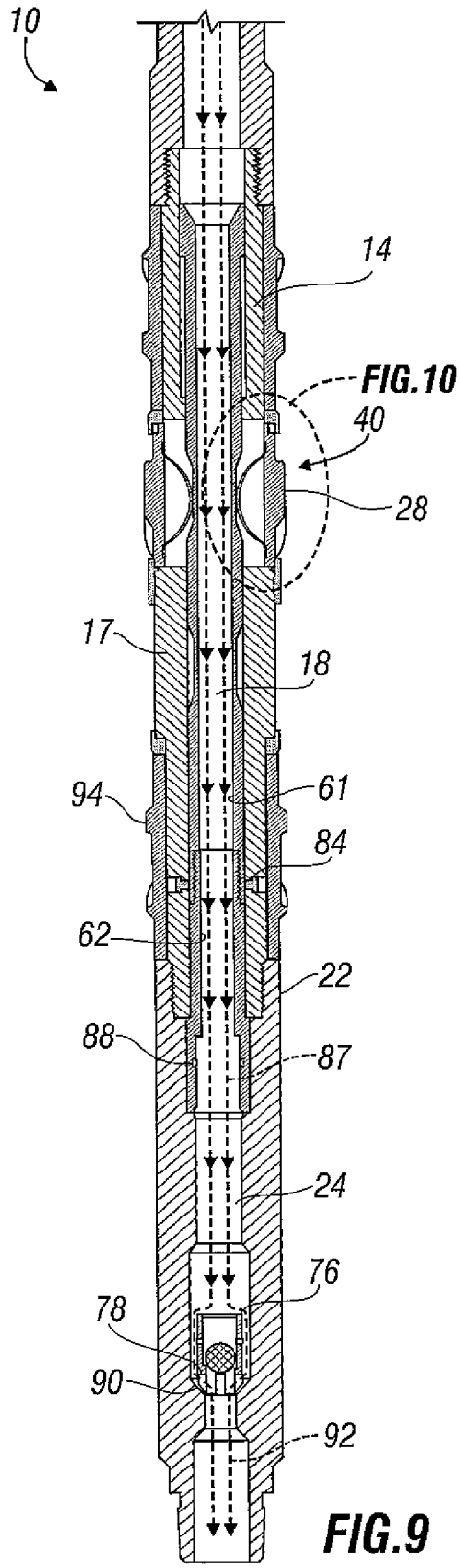
FIG. 9 is a cross-sectional view of the exemplary cleaning system of FIG. 6 showing the decoupling of the exemplary ball seat from the exemplary deactivation tube in accordance with an embodiment of the present invention.

Referring again to FIG. 5, if desired, the ball seat 76 may be releasable from the tube 58. In the example shown, the ball seat 76 is connected to the tube 58 with at least one uncoupling member 88, such as a shear pin, shear screw or other uncoupling mechanism. Each exemplary uncoupling member 88 is capable of tolerating the pressure needed to uncouple each uncoupling member 84, so that it will not shear or uncouple when the tube 58 is moved between positions. Upon the application of sufficient additional pressure in the bore 18 (as shown in FIG. 9 with fluid flow arrows 87) the uncoupling member(s) 88 will release, or shear, and separate the ball seat 76 from the tube 58. In this embodiment, the ball seat 76 is configured to drop through the bore 24 of the lower sub 22 until it reaches and stops at a reduced ID portion, or cavity 90, therein. The exemplary ball seat 76 should land and remain lodged at the cavity 90 of the bore 24.

Still referring to the embodiment of FIG. 5, the ball seat 76 may be configured to allow fluid to bypass it after it has been disconnected from the tube 58. For example, the lower portion of the ball seat 76 may have at least one vertical slot, or fluid passageway, 78 formed therein. Fluid may bypass the ball seat 76 and ball 80 located in the bore 24 of the lower sub 22 via the passageway(s) 78, such as indicated in FIG. 9 with fluid flow arrows 92. This configuration may, for example, allow unrestricted fluid flow down to a lower work string (not shown) after the mill blades 28 have been used and are retracted or deactivated, without necessitating removal of the system 10 from the well 12.

In yet another independent aspect of the present disclosure, additional components(s) and/or techniques may be used to assist in biasing the mill blades 28 into an extended position, or moving and retaining them in a retracted position. For example, referring to the embodiment of FIG. 10, one or more retraction spring 64 may be capable of assisting in moving and holding the inserts 40 in a retracted position. In some embodiments, the springs 64 may assist in moving the mill blades 28 to a retracted position to, or radially inward of, the outer diameter of the housing 14 or centralizers 94 (e.g. FIG. 1, and as described below) when the cleaning or deburring operation is complete, such as to prevent wear to the member 11 during continued reciprocation and/or rotation of the housing 14.

In the embodiment shown in FIG. 10, the retraction springs 64 are coil, or mill, blade springs 66. A pair of springs 66 is biased between each insert 40 and a respective retainer 46, 47 to apply radially inward spring force to the insert 40. Each spring 66 is disposed around a set screw 68 in a cavity 69 formed at the respective upper or lower end of the insert 40. The end of the spring 66 is placed in a spring cap 70 and biased against the respective retainer 46, 47. The head of the screw extends out of a hole 72 formed in the insert 40 from the cavity 60. It should be noted, however, that more or less than two coil springs 66 per insert 40 may be used in any suitable arrangement, or other types and arrangements of retraction springs 64 may instead or additionally be used. Further, the present disclose encompasses embodiments that do not include retraction springs 64.

As shown in FIG. 3, when the exemplary tube 58 is in its first position, the spring force of the bow spring 48 is greater than the combined spring forces of the coil springs 66, thus compressing the springs 66 and generally forcing the associated insert 40 in an extended position. When the illustrated tube 58 is in its second position (FIG. 10), the spring force of the bow spring 48 is sufficiently reduced to allow the coil springs 66 to expand and assist in biasing and retaining the associated insert 40 into a retracted position.

Referring back to FIG. 1, in yet another independent aspect of the present disclosure, one or more centralizer 94 may be included on the housing 14, such as to assist in centering the housing 14 in the generally cylindrically-shaped member 11, promote proper and equal pressure of the mill blades 28 on the inner diameter of the member 11, ensure full coverage in deviated or horizontal wells, or one or more other desired purposes. The centralizer(s) 94 may have any suitable form, configuration and operation. In this example, an upper centralizer 96 is positioned on the housing 14 above the mill blades 28 and a lower centralizer 98 is positioned on the housing 14 below the mill blades 28. The centralizers 94 may be full-gage centralizers sized to the drift diameter of the member 11 (e.g. FIG. 2) to ensure the inner diameter of the member 11 is not obscured for the placement or passage of other items, such as completion tool packers (not shown), or for any other desired purpose.

Referring to FIG. 2, each centralizer 96, 98 of this embodiment includes at least one ridge 100 extending outwardly in a generally spiral pattern therefrom. The ridges 100 of the upper and lower centralizers 96, 98 are shown spirally oriented in opposite directions, such as to assist in preventing the build-up of torque upon the centralizers 96, 98 and housing 14 during reciprocation thereof, assist in turbulent flow and to allow upward displacement (and removal) of fluid and debris in the bore (not shown) of the member 11 during use of the system 10 or any other purpose. In the example shown, the ridge 100 of the upper centralizer 96 extends in a clockwise direction and the ridge 100 of the lower centralizer 98 extends in a counterclockwise direction.

If desired, one or more portion of the centralizer(s) 94 may include HSM 35. For example, the lead-in bevel, or bottom edge, 99 of the lower centralizer 98 may include HSM 35, such as to assist in cleaning the member 11 or an associated component by reciprocating or rotating the housing 14. The edge 99 may be useful, for example, to assist in advance cleaning of perforation burs or other protrusions in, on or extending from, the member 11 (e.g. casing), assist in milling through tight spots in the member 11, or top-dress a liner top (not shown) prior to arrival of the mill blades 28 at the desired perforated area 25 to be cleaned, or any other suitable purpose.

In another aspect of the present invention, the cleaning system 10 may, if desired, be constructed without any externally facing or accessible screws, bolts or other connectors for any desired purpose. For example, the system 10 of the present embodiment includes only internally accessible connectors to avoid the possibility of one or more connector becoming loose or disconnected and falling into, or otherwise causing problems with, the generally cylindrically-shaped member 11 and/or well 12.

Figure 11:
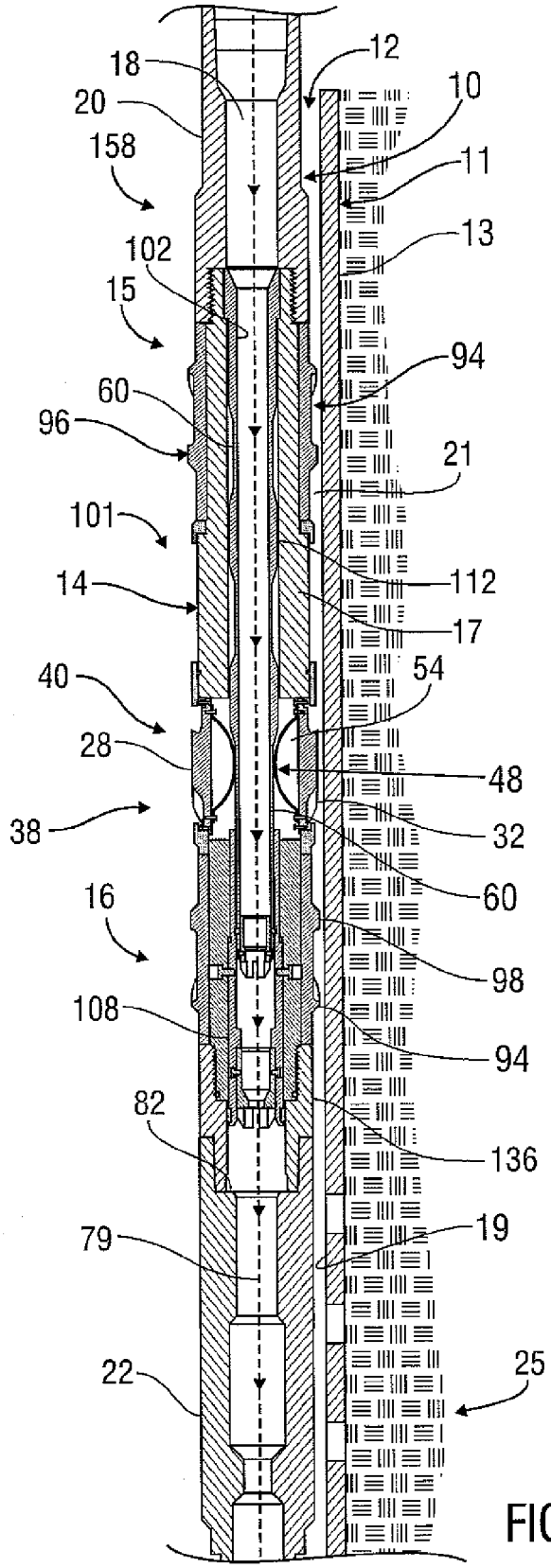
FIG. 11 is a cross-sectional view of another embodiment of a cleaning system in accordance with the present disclosure showing the exemplary mill blades in a retracted position as the cleaning system enters an underground well.

Now referring to FIG. 11, another embodiment of a cleaning system 10 in accordance with the present disclosure is shown. In contrast to the embodiments described above having mill blades 28 initially disposed in an extended position relative to the housing 14 upon delivery into the generally cylindrically-shaped member 11 (e.g. FIGS. 1-3), the mill blades 28 of this example are initially disposed in a retracted position relative to the housing 14. Accordingly, the system 10 is deployed into the generally cylindrically-shaped member 11, such as a well casing 13 or liner (not shown), with the mill blades 28 retracted. This may be beneficial in some applications, for example, to avoid damage to the mill blades 28 or interior surface 19 of the member 11 during deployment into and movement within the member 11. After the exemplary system 10 is disposed within the member 11, the mill blades 28 are movable into an extended position (e.g. FIG. 13). Otherwise, and other than any differences that are apparent from the description below and/or corresponding drawings, all of the features and details as described above with respect to, or are apparent from, FIGS. 1-10 are equally applicable to this embodiment and hereby incorporated by reference herein.

One exemplary potential use of this embodiment is during post-perforation and pre-completion operations, such as to remove perforating burrs and/or other debris from the inside of the well casing 13. In an example application, the cleaning system 10 may be incorporated into a drift sub 158, which is typically used to perform a gage ring run to drift the casing 13 prior to running completion hardware and accessories. For example, when the exemplary drift sub 158 encounters an obstruction, such as a perforation burr, the mill blades 28 of the system 10 may be extended to assist in preparing or cleaning the inner diameter of the perforated area 25. The incorporation of the exemplary cleaning system 10 as part of the drift sub 158 may thus save an otherwise necessary round trip into the casing 15 of a separate cleaning tool, such as a conventional mill. In some applications, such pre-completion cleaning may be particularly beneficial, such as when screens or packers (not shown) will be run into the casing 13. In some instances, for example, if the casing 15 is perforated in multiple zones, the exemplary mill blades 28 may be shifted to their extended position when the housing 14 is located above the uppermost perforated zone 25. Thereafter, the housing 14 may be reciprocated (and rotated, if desired) to clean or debur the uppermost perforated zone 25, then moved down in the bore 18 to clear or debur each successive lower perforated zone (not shown).

Figure 12:
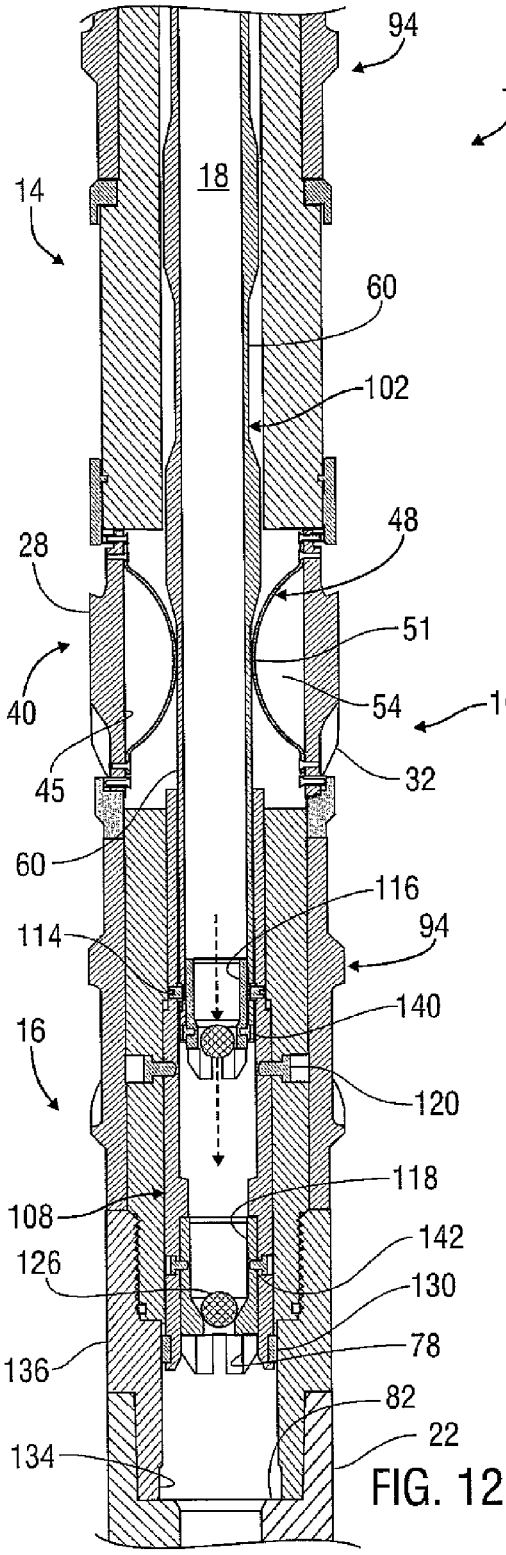
FIG. 12 is a cross-sectional view of the example cleaning system of FIG. 11 showing an activating member being engaged with a seat associated with the outer sleeve of an exemplary mill blade positioning device.

Referring now to FIG. 12, any suitable mechanism and technique may be used for initially positioning the mill blades 28 in a retracted position and thereafter moving them into an extended position. In this embodiment, a mill blade positioning device 101 includes inner and outer slideable flow tubes, or tubular sleeves, 102, 108, disposed in the bore 18 of the housing 14. As used herein to describe elements 102 and 108, the terms "sleeve" and "tube" are not limiting. Elements 102, 108 may have any suitable configuration, construction and operation, as long as they are capable of functioning as described herein. For example, the outer sleeve 108 may take the form of a ring. Further, the mill blade positioning device 101 may have a single or more than two sleeves, or different or additional components.

In this example, the outer sleeve 108 is located radially outward of the inner sleeve 102 and is releasably connected thereto. The illustrated sleeves 102, 108 allow fluid flow through the bore 18 of the housing 14, such as shown with flow arrow 79 in FIG. 11. Both sleeves 102, 108 are selectively movable in the bore 18 in a downward direction toward the lower end 16 of the housing 14. When the sleeves 102, 108 are engaged together, they are able to move in unison downwardly in the bore 18.

Still referring to the example of FIG. 12, the illustrated inner sleeve 102 contacts the bow 51 of each bow spring 48 and biases the bow springs 48 radially outwardly against the inserts 40, similarly as described above with respect to the sleeve 58 of the embodiment of FIG. 5. However, in this embodiment, the inner sleeve 102 is selectively moveable at least from a first position to a second position, and then to a third position. The illustrated outer sleeve 108 is moveable from a first position, which corresponds with the first position of the inner sleeve 102, to a second position, which corresponds with the second position of the inner sleeve 102. However, it should be noted, the inner and outer sleeves 102, 108 or other components of the mill blade positioning device 101 may be moveable between different or additional positions.

In FIG. 12, the inner and outer sleeves 102, 108 of this embodiment are shown in their respective first positions, which correspond with the retracted position of the inserts 40 (and mill blades 28). Each illustrated bow spring 48, which extends through a corresponding slot 54 in the housing 14, is shown biased between the outer diameter of the inner sleeve 102 and the rear side 45 of its corresponding insert 40. The bow 51 of each bow spring 48 is shown nested in an undercut 60 formed in the outer diameter of the inner sleeve 102. The illustrated undercut 60 is a thin-walled section of the sleeve 102, but may instead be similar to the undercut 60 shown and described with respect to the embodiment of FIG. 5. In this example, the undercut 60 provides only enough spring force upon the insert 40 to position the insert 40 and associated mill blade(s) 28 in a retracted position relative to the housing 14. In the retracted position, the outer surfaces of the illustrated mill blades 28 do not extend beyond the outer diameter of the housing 14 or other peripheral components, such as centralizers 94.

This configuration represents the assembled configuration of the illustrated system 10, in which the system 10 is lowered into the well 12 (e.g. FIG. 11). When the exemplary mill blades 28 are in a retracted position, their cleaning faces 32 will be spaced radially inwardly relative to the housing 14 and generally unable to contact the interior surface 19 (e.g. FIG. 11) of the member 11, avoiding damage or wear to the mill blades 28 or surface 19 during deployment of the system 10 into the generally cylindrically-shaped member 11.

Figure 13:
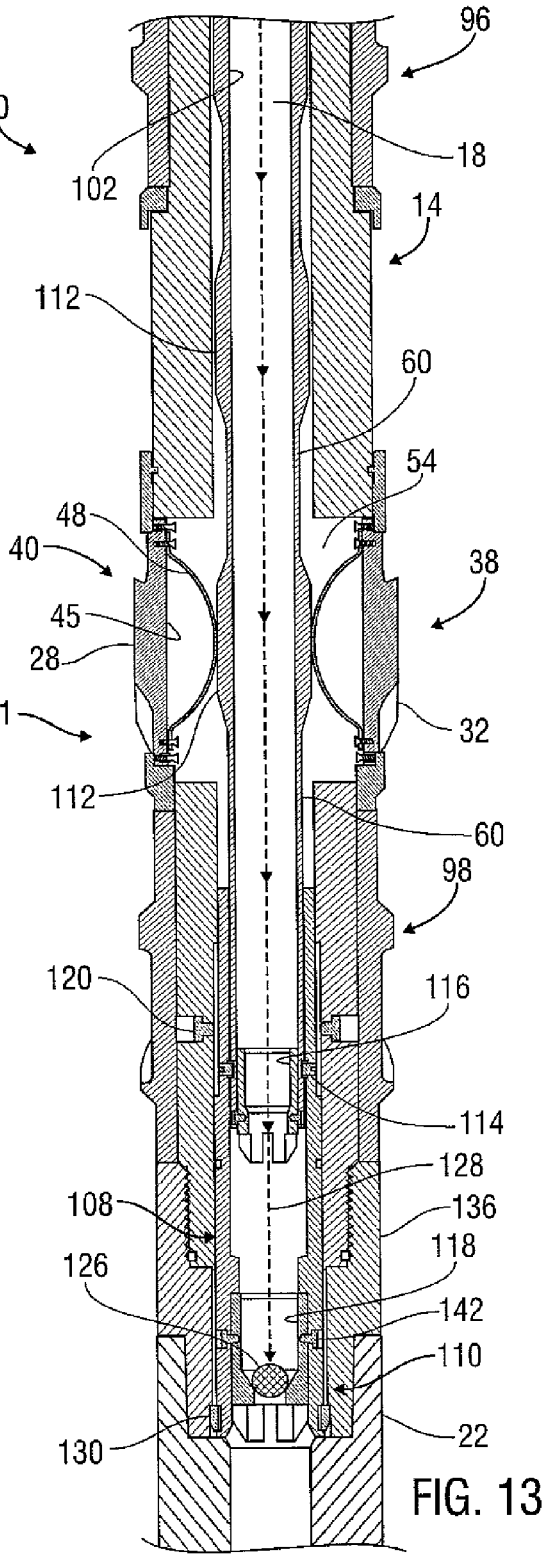
FIG. 13 is a cross-sectional view of the example cleaning system of FIG. 11 showing the exemplary mill blades shifted to an extended position.

The second positions of the inner and outer sleeves 102, 108 of this embodiment are shown in FIG. 13 and correspond with an extended position of the inserts 40 and mill blades 28. After the illustrated inner and outer sleeves 102, 108 are moved into their second positions, each bow spring 48 is biased between a thick-walled section, or protrusion, 112 of the inner sleeve 102 and the rear side 45 of its corresponding insert 40 sufficient to bias the insert 40 and associated mill blade(s) 28 into an extended position. In the extended position, the exemplary mill blades 28 are in position to contact and clean the interior surface 19 (e.g. FIG. 11) of the generally cylindrically-shaped member 11, such as described above with respect to the embodiments of FIGS. 1-10.

However, the present disclosure is not limited to the use of undercuts 60 and protrusions 112 formed on the exemplary inner sleeve 20 to bias the mill blades 28 in the retracted and extended positions. Any other configuration or arrangement of parts that appropriately positions the mill blades 28 may be used.

Figure 16:
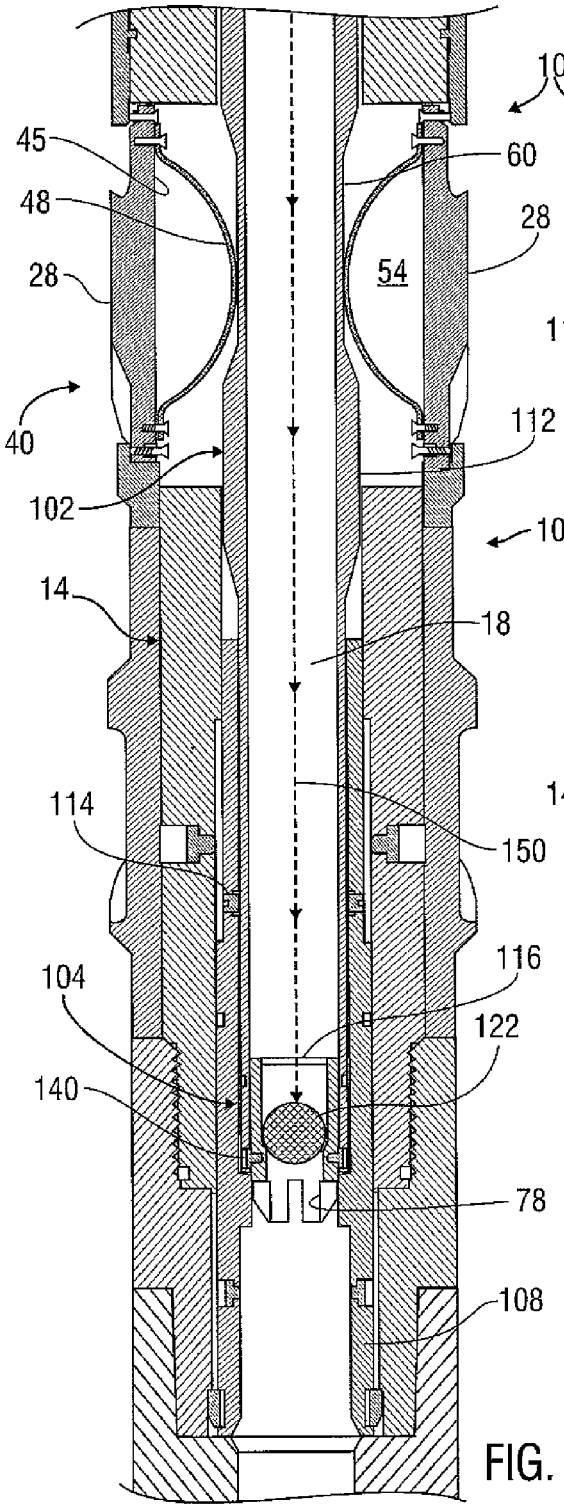
FIG. 16 is a cross-sectional view of the example cleaning system of FIG. 11 showing the exemplary mill blades shifted to a retracted position.

The third position of the exemplary inner sleeve 102, which corresponds with a retracted position of the inserts 40 and mill blades 28, is shown in FIG. 16. In this state, the inserts 40 and mill blades 28 are similarly situated as described above with respect to FIG. 12.

The inner and outer sleeves 102, 108 may be moveable between positions in any suitable manner. Referring back to FIG. 12, the illustrated inner and outer sleeves 102, 108 are releasably connected with at least one uncoupling member 114, and the outer sleeve 108 and housing 14 are releasably connected with at least one uncoupling member 120. The exemplary uncoupling members 114, 120 are useful to help initially secure the inner and outer sleeves 102, 108 in their respective first positions until the mill blades 28 are moved to an extended position.

The uncoupling members 114, 120, as well as other uncoupling members as will be mentioned below, may have any suitable form, configuration and operation. Some examples of uncoupling members useful in certain applications are shear pins and shear screws. The amount of bore pressurization needed to break or disengage an uncoupling member may be selected based upon the shear valve of the uncoupling members, or vise versa. Each exemplary uncoupling member is capable of tolerating the pressure applied in the bore 18 during operations that precede its desired disengagement so that it will not uncouple prematurely. Further, each uncoupling member mentioned herein may include multiple uncoupling members, typically spaced apart around the periphery of an associated component. The precise number of uncoupling members used in each referenced instance may depend upon the shear value of the uncoupling members being used, the bore pressurization needed to disengage the uncoupling members, available space or other variables. In some instances, two or three uncoupling members may be sufficient or desirable for a particular purpose. In other instances, up to nine uncoupling members may be used. However, the type and number of uncoupling members used in each instance is not limiting upon the present disclosure.

Still referring to the embodiment of FIG. 12, each sleeve 102, 108 includes at least one releasable seat 116, 118, respectively. Each exemplary seat 116, 118 is capable of catching a respective activating member 122, 126 inserted into the bore 18 of the housing 14. The seats 116, 118 and activating members 122, 126 may have any suitable form, configuration and construction. For example, in some embodiments, the seats 116, 118 may be non-deformable ball or dart seats, and the activating members may be balls, darts or spears, as are and become know. Each illustrated seat 116, 118 is engaged with its respective sleeve 102, 108 with at least one uncoupling member 140, 142, respectively.

As shown in FIG. 12, to move the sleeves 102, 108 from their respective first to second positions, the activating member 126 is inserted or dropped into the bore 18. The activating member 126 is sized to pass through the seat 116 of the inner sleeve 102 and land in the seat 118 of the outer sleeve 108. After the activating member 126 is landed in the exemplary seat 118, sufficient pressurization in the bore 18, such as shown in FIG. 13 with flow arrow 128, will cause the uncoupling member 120 to release and allow both sleeves 102, 108 to move in unison down in the bore 18.

As shown in FIG. 13, both sleeves 102, 108 of this example will move down the bore 18 in unison until the lower end 110 of the outer sleeve 108 stops at a decreased ID portion, or shoulder 82 (FIG. 12). The exemplary shoulder 82 is shown formed in the lower sub 22, though it may be formed in any other suitable component. Moreover, any other suitable mechanism or technique may be used to stop the concurrent downward movement of the inner and outer sleeves 102, 108.

This disposition of the inner and outer sleeves 102, 108 defines their respective second positions. In the second position, the illustrated inner sleeve 102 biases the mill blades 28 into an extended position, as described above. In at least some applications, when the exemplary mill blades 28 of this embodiment are in an extended position, they are capable of at least substantially contacting and cleaning protruding debris from the entire circumference of the interior surface 19 (e.g. FIG. 11) of at least a portion of the generally cylindrically-shaped member 11 upon reciprocation of the housing 14 therein. Further, the exemplary spring-biased mill blades 28 are capable of reaching the full inner diameter of the member 11. This allows use of the illustrated system 10 to mill, or clean, the desired portion(s) of the interior surface 19 (e.g. FIG. 11) of the generally cylindrically-shaped member 11, such as one or more perforated intervals of a casing 13.

If desired, the lower end 110 of the outer sleeve 108 may be fitted with a snap-ring 130 (FIG. 12) or like component that expands into a groove 134, or other area, formed near the shoulder 82, such as in a mid-sub 136. The illustrated snap-ring 130 (or like component) assists in securing the inner and outer sleeves 102, 108 in their second positions and locking the mill blades 28 in their expanded positions during cleaning (e.g. deburring) operations.

Figure 14:
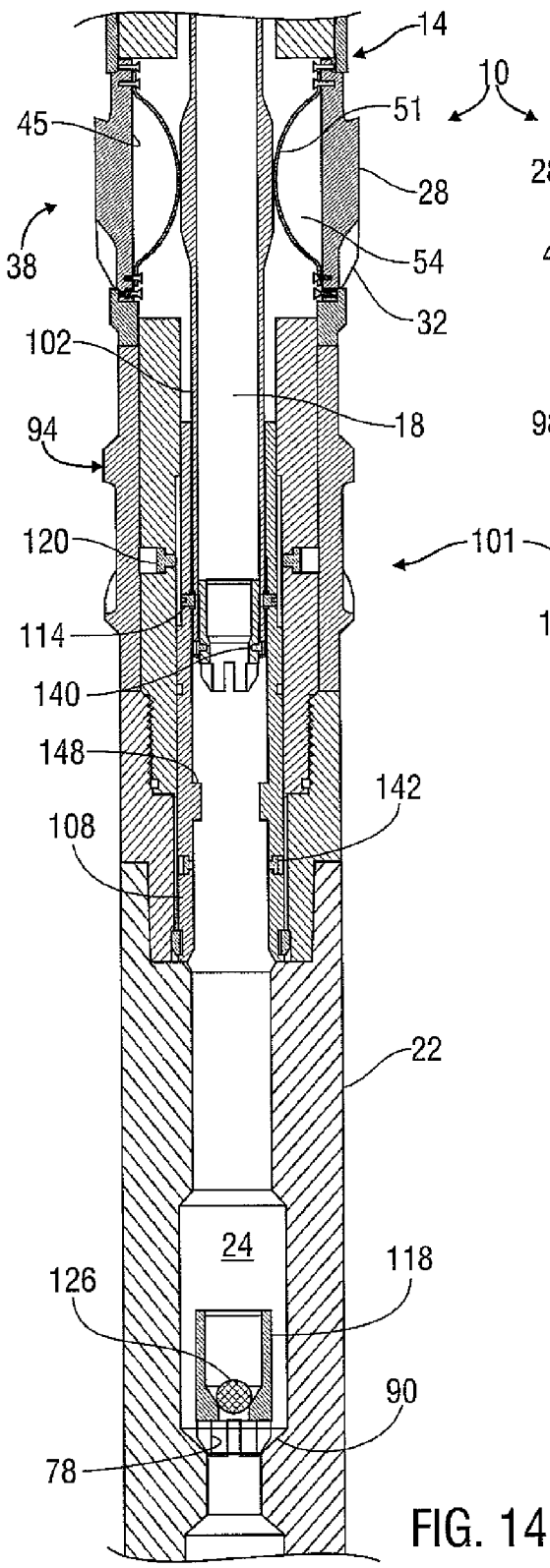
FIG. 14 is a cross-sectional view of the example cleaning system of FIG. 11 showing the seat associated with the outer sleeve being disengaged therefrom.

Thereafter, the mill blades 28 may be moved back to a retracted position. Referring to FIG. 14, to move the exemplary inner sleeve 102 to its third position and the mill blades 28 back to a retracted position, the bore 18 is pressurized sufficient to disengage the uncoupling member 142 (FIG. 13) and release the seat 118 from the outer sleeve 108. In this embodiment, the seat 118 is configured to drop through the bore 24 of the lower sub 22 until it reaches and stops at a reduced ID portion, or cavity 90, therein. The exemplary seat 118 should land and remain lodged in the cavity 90 of the bore 24. However, the system 10 may be configured so that the seat 118 moves to any other desired location.

If desired, the seat 118 may be configured to allow fluid to bypass it after it has been disconnected from the outer sleeve 108. For example, the lower portion of the seat 118 may have at least one vertical slot, or fluid passageway, 78 formed therein. Fluid may thus bypass the detached seat 118 and associated activating member 126, such shown in FIG. 17 with flow arrow 154. In at least some applications, this configuration may allow unrestricted downward fluid flow through the bore 18, such as to a work string (not shown) located below the lower sub 22, after the mill blades 28 have been used and are retracted, without necessitating removal of the system 10 from the well 12 (e.g. FIG. 11).

Figure 15:
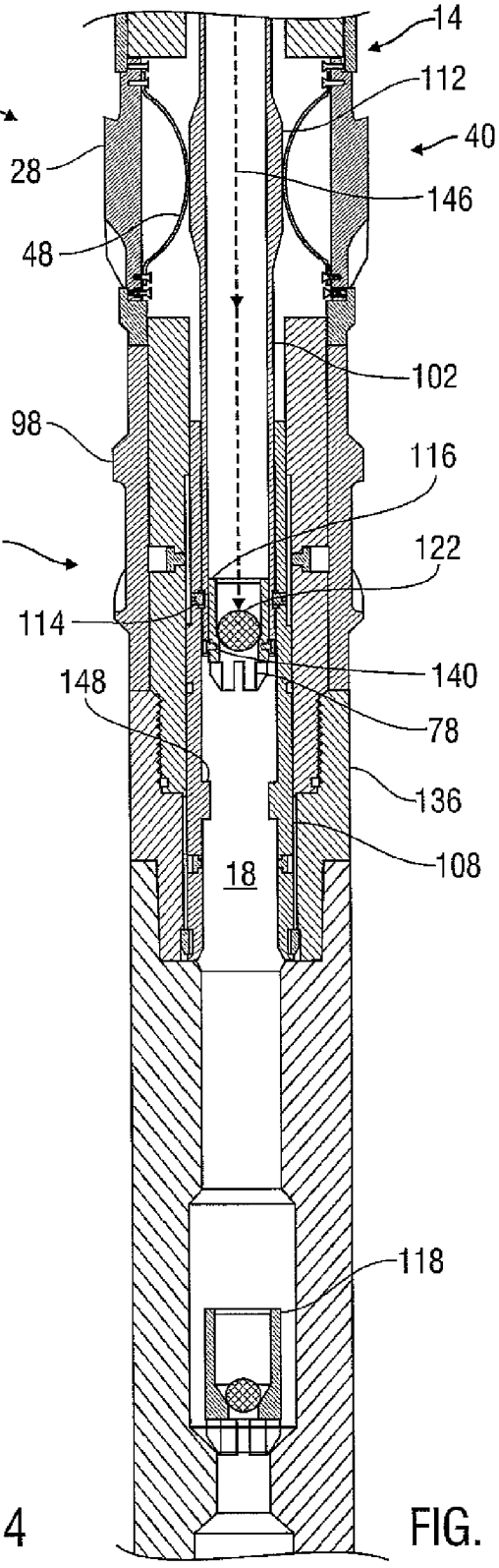
FIG. 15 is a cross-sectional view of the example cleaning system of FIG. 11 showing another activating member being engaged with a seat associated with the inner sleeve of the exemplary mill blade positioning device.

Thereafter, referring to FIG. 15, the activating member 122 of this embodiment is inserted or dropped into the bore 18. The illustrated activating member 122 is sized to land in the seat 116 of the inner sleeve 102. After the activating member 122 lands in the exemplary seat 116, sufficient pressurization in the bore 18 (e.g. arrow 146) will cause the uncoupling member(s) 114 to release, allowing the inner sleeve 102 to move downwardly relative to the outer sleeve 108 and housing 14. As shown in FIG. 16, in this embodiment, the inner sleeve 102 will move down the bore 18 until its lower end 104 stops at a decreased ID portion, or shoulder 148 (FIG. 15), of the outer sleeve 108. However, any other suitable mechanism or technique may be used to stop the downward movement of the inner sleeve 102.

This disposition of the exemplary inner sleeve 102, as shown in FIG. 16, defines its third position. In this position, the bow springs 48 nest in another set of undercuts 60 (such as a groove, thin-walled or cut-out portion), formed in the outer diameter of the inner sleeve 102, positioning the illustrated inserts 40 and associated mill blades 28 in a retracted position. This allows, for example, further movement, or removal, of the system 10 without the mill blades 28 contacting the interior surface 19 (e.g. FIG. 11) of the generally cylindrically-shaped member 11.

Figure 17:
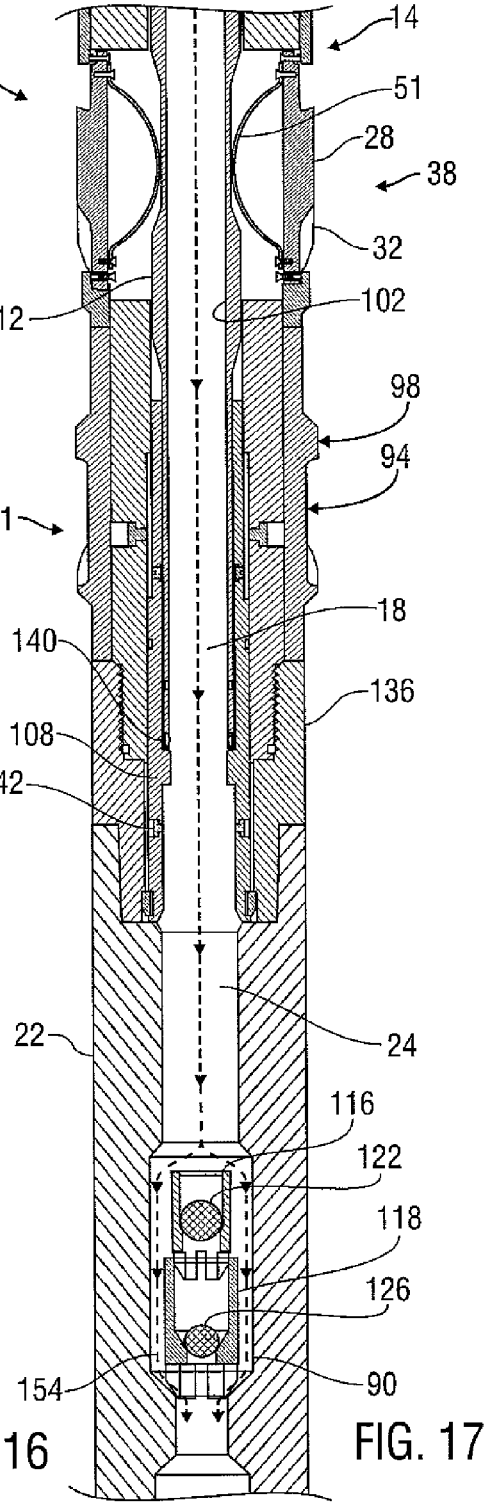
FIG. 17 is a cross-sectional view of the example cleaning system of FIG. 11 showing the seat associated with the inner sleeve being disengaged therefrom.

Still referring to FIG. 16, to allow fluid flow through the bore 18 of the housing 14, the bore 18 is again pressurized (e.g. flow arrow 150) sufficient to shear or disengage the uncoupling member 140 and release the seat 116 from the inner sleeve 102. In this embodiment, as shown in FIG. 17, the seat 116 is configured to drop through the bore 24 of the lower sub 22 until it reaches and stops at the reduced ID portion, or cavity 90, therein. The exemplary seat 116 should land and remain lodged at the cavity 90 of the bore 24, along with the seat 118. However, the system 10 may be configured so that the seat 116 moves to any other desired location.

If desired, the seat 116 may be configured to allow fluid to bypass it (e.g. arrows 154, FIG. 17) after it has disengaged from the inner sleeve 102. For example, the seat 116 may include one or more fluid passageways 78 (FIG. 15) to assist in allowing fluid flow thereby. Thereafter, fluid flow through the bore 18 may be restored and, if desired, the system 10 may be lifted up and out of, or otherwise moved within, the generally cylindrically-shaped member 11 (e.g. FIG. 11) without the mill blades 28 contacting the interior surface 19.

Preferred embodiments of the present disclosure thus offer advantages over the prior art and are well adapted to carry out one or more of the objects of this disclosure. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that are provided in or apparent from the description above or claimed herein, and any other methods which may fall within the scope of the appended claims, may be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A drift sub equipped to be capable of cleaning at least part of the interior surface of a casing in a subterranean well prior to the insertion therein of completion hardware and/or accessories, the drift sub comprising:

a tubular housing having an upper end, a lower end and a bore extending therebetween, said housing being deployable into and moveable within the casing;

a plurality of mill blades supported on said housing and arranged in at least one row around the outer circumference of said housing, each said mill blade being movable between at least one retracted position and at least one extended position relative to the housing, said mill blades in said extended position extending radially outwardly beyond the outer diameter of said housing and capable of contacting the interior surface of the casing, and said mill blades in said retracted position being unable to contact the interior surface of the casing, wherein said mill blades are initially positioned in said retracted position upon deployment of said housing into the casing;

an inner sleeve disposed within said bore of said housing and biasingly engaging each said mill blade, said inner sleeve being configured to be selectively movable axially relative to said housing only in the direction of said lower end thereof at least from a first position to a second position and therefrom to a third position, said inner sleeve in said first and third positions biasing said mill blades in said retracted position and said inner sleeve in said second position biasing said mill blades in said extended position; and an outer sleeve disposed within said bore radially outwardly relative to said inner sleeve and being releasably engaged therewith, said outer sleeve being configured to be selectively moveable axially relative to the housing only in the direction of said lower end thereof at least from a first position to a second position, wherein movement of said outer sleeve from its said first position to its said second position causes said inner sleeve to move from its said first position to its said second position, wherein said inner and outer sleeves are configured to be positioned in said respective first positions upon deployment of said housing into the casing and, thereafter, movement of said outer sleeve from its said first position to its said second position moves said inner sleeve from its said first position to its said second position, causing said mill blades to move into said extended position, and movement thereafter of said inner sleeve from its said second position to its said third position causes said mill blades to move into said retracted position, and whereby said inner sleeve in its third said position is unable to move back to its first or second said positions, securing said mill blades in said retracted position.

2. The drift sub of claim 1 wherein said inner and outer sleeves are configured to be movable based upon increases in pressure in said bore.

3. The drift sub of claim 2 further including a first detachable seat releasably engaged with said outer sleeve and useful to catch a first activating member inserted into said bore of said housing, wherein said outer sleeve is configured to move from its said first position to its said second position upon seating of said first activating member within said first seat and application of sufficient downward pressure within said bore of said housing, further wherein said first seat is configured to be releasable from said outer sleeve upon the application of additional sufficient downward pressure in said housing, allowing fluid flow through said bore of said housing thereafter.

4. The drift sub of claim 3 further including a second detachable seat releasably engaged with said inner sleeve and useful to catch a second activating member inserted into said bore of said housing, wherein said inner sleeve is configured to move from its said second position to its said third position upon seating of said second activating member within said second seat and application of sufficient downward pressure within said bore of said housing, further wherein said second seat is configured to be releasable from said inner sleeve upon the application of additional sufficient downward pressure in said housing, allowing fluid flow through said bore of said housing thereafter.

5. The drift sub of claim 4 wherein said first seat is located between said second seat and said lower end of said housing, and said first activating member is sized to pass through said second seat and engage said first seat.

6. The drift sub of claim 4 where each of said first and second activating members are at least one among a ball, a dart and a spear, and wherein said second activating member has a width that is larger than the width of said first activating member.

7. The drift sub of claim 4 further including first, second, third and fourth sets of releasable uncoupling members, each said set of uncoupling members including at least first and second uncoupling members, said first set of uncoupling members initially engaged between said outer sleeve and said housing, said second set of uncoupling members initially engaged between said first seat and said outer sleeve, said third set of uncoupling members initially engaged between said inner and outer sleeves and said fourth set of uncoupling members initially engaged between said second seat and said inner sleeve.

8. The drift sub of claim 7 wherein each said uncoupling member is at least one among a shear pin and a shear screw.

9. The drift sub of claim 2 further including at least one lower sub engaged with the lower end of said housing, at least one said lower sub having a first reduced-diameter portion, wherein said outer sleeve is configured to land and be retained in said first reduced-diameter portion in its said second position.

10. The drifts sub of claim 9 further including a snap-ring disposed proximate to the lower end of said outer sleeve and wherein said first reduced-diameter portion includes a groove, whereby said snap-ring expands into said groove when said outer sleeve moves into its said second position to assist in retaining said outer sleeve in said second position.

11. The drift sub of claim 2 wherein said outer sleeve has a reduced inner-diameter portion, wherein said inner sleeve is configured to land and be retained in said reduced inner-diameter portion of said outer sleeve in its said third position.

12. The drift sub of claim 1 wherein each said mill blade is spirally-oriented and has at least one cleaning face capable of contacting the interior surface of the casing when said mill blades are in said extended position, wherein said mill blades are arranged in at least first and second rows on said housing so that said plurality of cleaning faces will, in combination, span the entire circumference of the bore of at least a portion of the casing when said housing is deployed within the casing, whereby said mill blades in said extended position are capable of cleaning the interior surface along substantially the entire circumference of at least a portion of the casing upon reciprocation of said housing.

13. The drift sub of claim 12 further including at least first and second centralizers, said first centralizer being disposed on said housing above said mill blades and said second centralizer being disposed on said housing below said mill blades, wherein when said mill blades are in a retracted position, said mill blades are radially inward of the outer diameter of said centralizers and the drift sub is useful to drift the casing.

14. Apparatus useful to clean at least part of the interior surface of a generally cylindrically-shaped member in a subterranean well, the apparatus comprising:

a housing having an upper end, a lower end and a bore extending therebetween, said housing being deployable into and moveable within the generally cylindrically-shaped member;

a plurality of mill blades supported on said housing and arranged in at least one row around the outer circumference of said housing, each said mill blade being movable between at least one retracted position and at least one extended position relative to the housing, said mill blades in said extended position extending radially outwardly beyond the outer diameter of said housing and capable of contacting the interior surface of the generally cylindrically-shaped member, and said mill blades in said retracted position being unable to contact the interior surface of the generally cylindrically-shaped member, wherein said mill blades are initially positioned in said retracted position upon deployment of said housing into the generally cylindrically-shaped member;

an inner sleeve disposed within said bore of said housing and biasingly engaging each said mill blade, said inner sleeve being configured to be selectively movable axially relative to said housing only in the direction of said lower end thereof at least from a first position to a second position and therefrom to a third position, said inner sleeve in said first and third positions biasing said mill blades in said retracted position and said inner sleeve in said second position biasing said mill blades in said extended position;

an outer sleeve disposed within said bore radially outwardly relative to said inner sleeve and being releasably engaged therewith, said outer sleeve being configured to be selectively moveable axially relative to the housing only in the direction of said lower end thereof at least from a first position to a second position, wherein movement of said outer sleeve from its said first position to its said second position causes said inner sleeve to move from its said first position to its said second position; and first and second detachable seats releasably engaged with said outer and inner sleeves, respectively, said first detachable seat useful to catch a first activating member inserted into said bore of said housing and move said inner and outer sleeves from their said first to said second respective positions, and said second detachable seat useful to catch a second activating member inserted into said bore and move said inner sleeve from its said second to third position.

15. The apparatus of claim 14 wherein said mill blades are disposed upon and extend radially outwardly from a plurality of inserts, and wherein said housing includes a plurality of pockets formed therein and extending only partially into said wall thereof from the outer surface thereof, said pockets being arranged in spaced relationship with one another around the circumference of said housing in at least said first and second rows, said pockets of said first row being offset on said housing relative to said pockets of said second row, each said insert being retained and moveable between retracted and extended positions within one of said pockets, wherein the retraction of each said insert is limited by the depth of said associated pocket, and wherein at least some torque that may be applied to said mill blades during use of the apparatus is transmittable to said wall of said housing.

16. The apparatus of claim 15 further including a plurality of bow springs, at least one said bow spring engaged with and providing spring forces against each said insert within one of said pockets, further wherein said housing includes a plurality of slots extending through said wall thereof within each said pocket, wherein each said bow spring extends through one of said slots in said housing, and wherein said inner sleeve includes a plurality of protrusions extending from the outer diameter thereof, wherein when said inner sleeve is in said second position, each said bow spring is biased against one said protrusion, increasing the spring forces applied to said associated insert and allowing said insert to move into said extended position.

17. The apparatus of claim 16 further including a plurality of mill blade springs, at least one said mill blade spring associated with each said insert, said mill blade springs configured to apply radially inward spring force upon said associated insert, wherein when said sleeve is in said first and third positions, each said mill blade spring assists in biasing said associated insert into a retracted position.

18. A method of cleaning debris from at least part of the interior surface of a generally cylindrically-shaped member in a subterranean well with the use of a housing having a plurality of spring-biased mill blades associated therewith and an inner sleeve disposed within a bore thereof, the mill blades arranged in at least one row around the outer circumference of the housing, each mill blade being movable from a retracted position to an extended position and therefrom to a retracted position relative to the housing, the mill blades in an extended position extend radially outwardly beyond the outer diameter of the housing and are capable of contacting the interior surface of the generally cylindrically-shaped member, and the mill blades in a retracted position are unable to contact the interior surface of the generally cylindrically-shaped member the inner sleeve biasingly engaging each mill blade, the inner sleeve being configured to be selectively movable axially relative to the housing only in the direction of a lower end thereof at least from a first position to a second position and therefrom to a third position, the method comprising:

positioning the mill blades in a retracted position;

inserting the housing into the generally cylindrically-shaped member, the housing having an upper end, a lower end and a bore therethrough;

moving the mill blades into an extended position by moving the inner sleeve from its first position to its second position;

reciprocating the housing to allow the mill blades to clean the interior surface of at least a portion of the generally cylindrically-shaped member;

moving the mill blades into a retracted position by moving the inner sleeve from its second position to its third position, wherein the mill blades are thereafter unable to move back into an extended position; and removing the housing from the generally cylindrically-shaped member.

19. The method of claim 18 wherein the housing includes inner and outer sleeves disposed within the bore thereof, further including inserting a first ball into the bore of the housing to engage a detachable seat associated with the outer sleeve, increasing the fluid pressure in the bore to move the inner and outer sleeves downwardly in the bore toward the lower end of the housing, causing the mill blades to move from a retracted to an extended position, inserting a second ball into the bore of the housing to engage a second detachable seat associated with the inner sleeve, and increasing the fluid pressure in the bore to move the inner sleeve downwardly in the bore toward the lower end of the housing, causing the mill blades to move from an extended to a retracted position.

20. The method of claim 19 further including, after the mill blades move to an extended position, increasing the fluid pressure in the bore to cause the seat associated with the outer sleeve to detach from the outer sleeve and, thereafter, after the mill blades move to a retracted position, increasing the fluid pressure in the bore to cause the seat associated with the inner sleeve to detach from the inner sleeve.

* * * * *